US006698328B1

(12) United States Patent
Schmidt

(10) Patent No.: US 6,698,328 B1
(45) Date of Patent: Mar. 2, 2004

(54) MITRE BOX

(75) Inventor: Sheldon Schmidt, Paramus, NJ (US)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 3 days.

(21) Appl. No.: 10/117,671

(22) Filed: Apr. 8, 2002

Related U.S. Application Data

(63) Continuation-in-part of application No. 10/038,430, filed on Jan. 7, 2002.

(51) Int. Cl.[7] ..... B27G 5/02
(52) U.S. Cl. ..... 83/766; 83/468.3; 83/827
(58) Field of Search ..... 83/762, 763, 764, 83/765, 766, 767, 468.7, 468, 451–454, 581, 758, 825–829, 468.1–468.6

(56) References Cited

U.S. PATENT DOCUMENTS

| | | | | | |
|---|---|---|---|---|---|
| 99,398 | A | | 2/1870 | Bullard | |
| 117,538 | A | | 8/1871 | Hedges | |
| 339,455 | A | | 4/1886 | Olmsted | |
| 369,770 | A | * | 9/1887 | Brewster et al. | 83/763 |
| 415,940 | A | | 11/1889 | Davis | |
| 477,233 | A | | 6/1892 | Soukup | |
| 536,936 | A | | 4/1895 | Nicholls | |
| 542,738 | A | | 7/1895 | Levan | |
| 577,227 | A | | 2/1897 | Bolig | |
| 600,118 | A | | 3/1898 | Bruno | |
| 744,677 | A | | 11/1903 | Briggs | |
| 780,657 | A | | 1/1905 | Holt | |
| 1,002,980 | A | * | 9/1911 | Fish | 83/767 |
| 1,013,010 | A | | 12/1911 | Graham | |
| 1,089,761 | A | | 3/1914 | Gladwin | |
| 1,155,912 | A | | 10/1915 | Grabowsky | |
| 1,175,811 | A | | 3/1916 | Ray | |
| 1,203,417 | A | | 10/1916 | Schade | |
| 1,208,150 | A | | 12/1916 | Hall | |
| 1,332,713 | A | * | 3/1920 | Darcy | 83/767 |
| 1,332,714 | A | * | 3/1920 | Darcy et al. | 83/767 |
| 1,582,616 | A | * | 4/1926 | McMillan | 83/767 |
| 1,808,611 | A | | 6/1931 | Running | |
| 1,952,518 | A | * | 3/1934 | Stowell | 83/763 |
| 2,050,699 | A | | 8/1936 | Gommel | |
| 2,644,493 | A | * | 7/1953 | Hempe | 83/763 |
| 2,748,811 | A | * | 6/1956 | Chilton | 83/766 |
| 2,912,019 | A | * | 11/1959 | Hempe | 83/763 |
| 2,912,288 | A | | 11/1959 | Griswold | |
| 3,273,612 | A | * | 9/1966 | Keddie | 83/761 |
| 3,397,722 | A | | 8/1968 | Long | |
| 3,464,744 | A | | 9/1969 | Fall | |
| 3,590,891 | A | | 7/1971 | Guglieimo | |
| 4,241,634 | A | * | 12/1980 | Ambler | 83/763 |
| 4,262,571 | A | | 4/1981 | King | |
| 4,270,588 | A | * | 6/1981 | Neft | 30/501 |
| 4,300,755 | A | | 11/1981 | Potvin | |
| 4,455,908 | A | * | 6/1984 | Keddie | 83/767 |
| 5,259,286 | A | * | 11/1993 | Chen | 83/766 |
| 5,279,198 | A | * | 1/1994 | Cross | 83/758 |
| 5,845,410 | A | * | 12/1998 | Boker | 33/536 |
| 5,957,023 | A | | 9/1999 | Cheng | |
| 2002/0029678 | A1 | * | 3/2002 | Erisoty | 83/766 |

* cited by examiner

*Primary Examiner*—Allan N. Shoap
*Assistant Examiner*—Ghassem Alie
(74) *Attorney, Agent, or Firm*—Joseph J. Previto

(57) ABSTRACT

A mitre box having a base and a saw holder assembly pivotally mounted for angular movement over the base. The saw holder assembly is adapted to hold a saw and is capable of being locked at a predetermined angular position over the base.

11 Claims, 4 Drawing Sheets

MITRE BOX

RELATED APPLICATION

This application is a continuation-in-part of pending application Ser. No. 10/038,430 filed Jan. 7, 2002.

BACKGROUND

The present invention relates to a mitre box and more particularly to an adjustable mitre box.

Adjustable mitre boxes have been in use for a number of years. They comprise a pivoted saw holder which is angularly movable relative to an upstanding side wall. By rotating the saw holder to different angles relative to the side wall, cuts of different angles may be made in a piece of wood. It has been found that existing adjustable mitre boxes are complicated to use and complicated and expensive to manufacture and maintain.

OBJECTS

The present invention overcomes these drawbacks and has for one of its objects the provision of an improved adjustable mitre box which is simple to use.

Another object of the present invention is the provision of an improved mitre box which is simple and inexpensive to manufacture and maintain.

Other and further objects of the invention will be obvious upon an understanding of the illustrative embodiment about to be described, or will be indicated in the appended claims and various advantages not referred to herein will occur to one skilled in the art upon employment of the invention in practice

DRAWINGS

A preferred embodiment of the invention has been chosen for purposes of illustration and description and is shown in the accompanying drawings forming a part of the specification wherein.

DESCRIPTION

Figure 1:
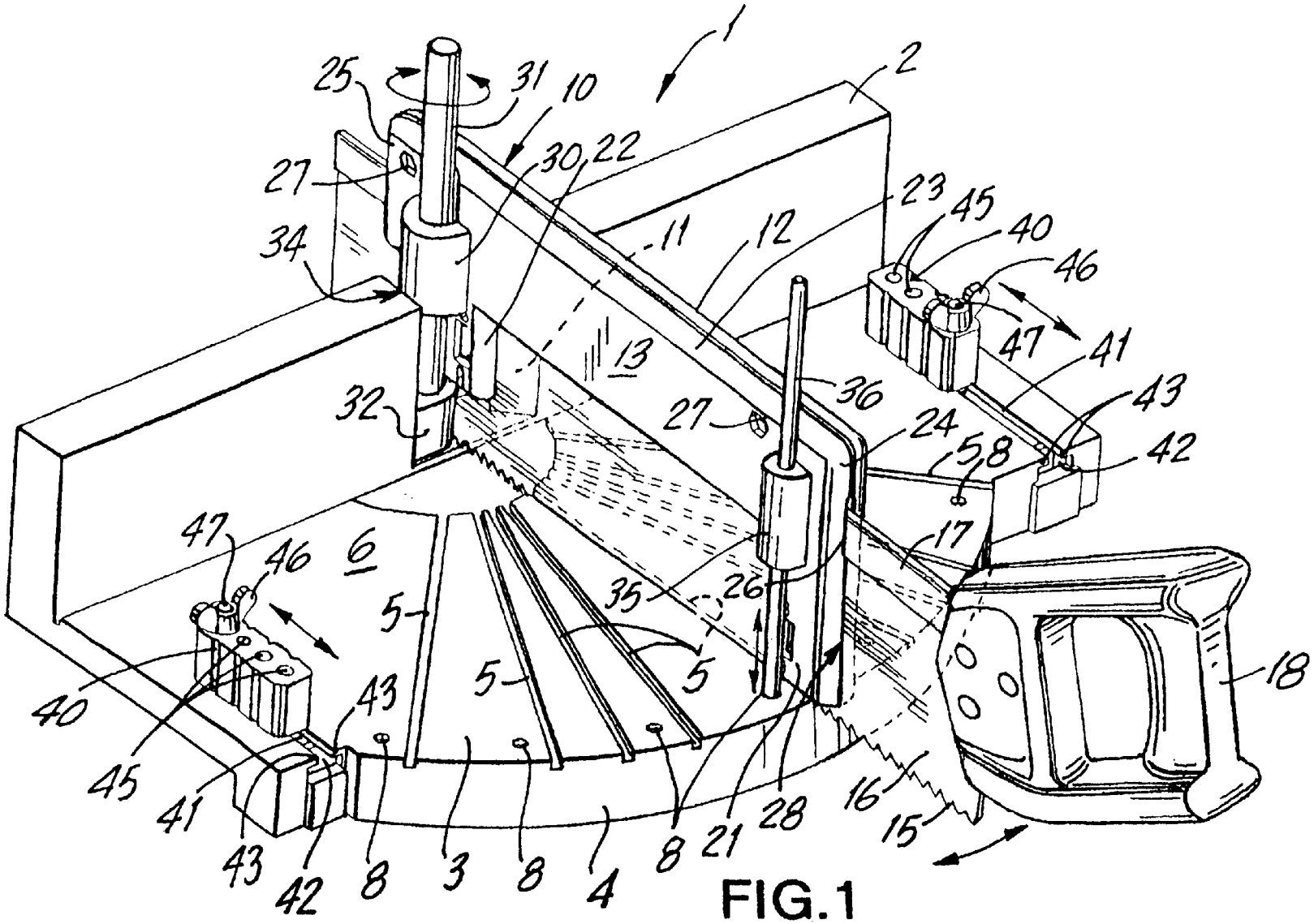
FIG. 1 is a perspective view of an adjustable mitre box made in accordance with the present invention.
Figure 2:
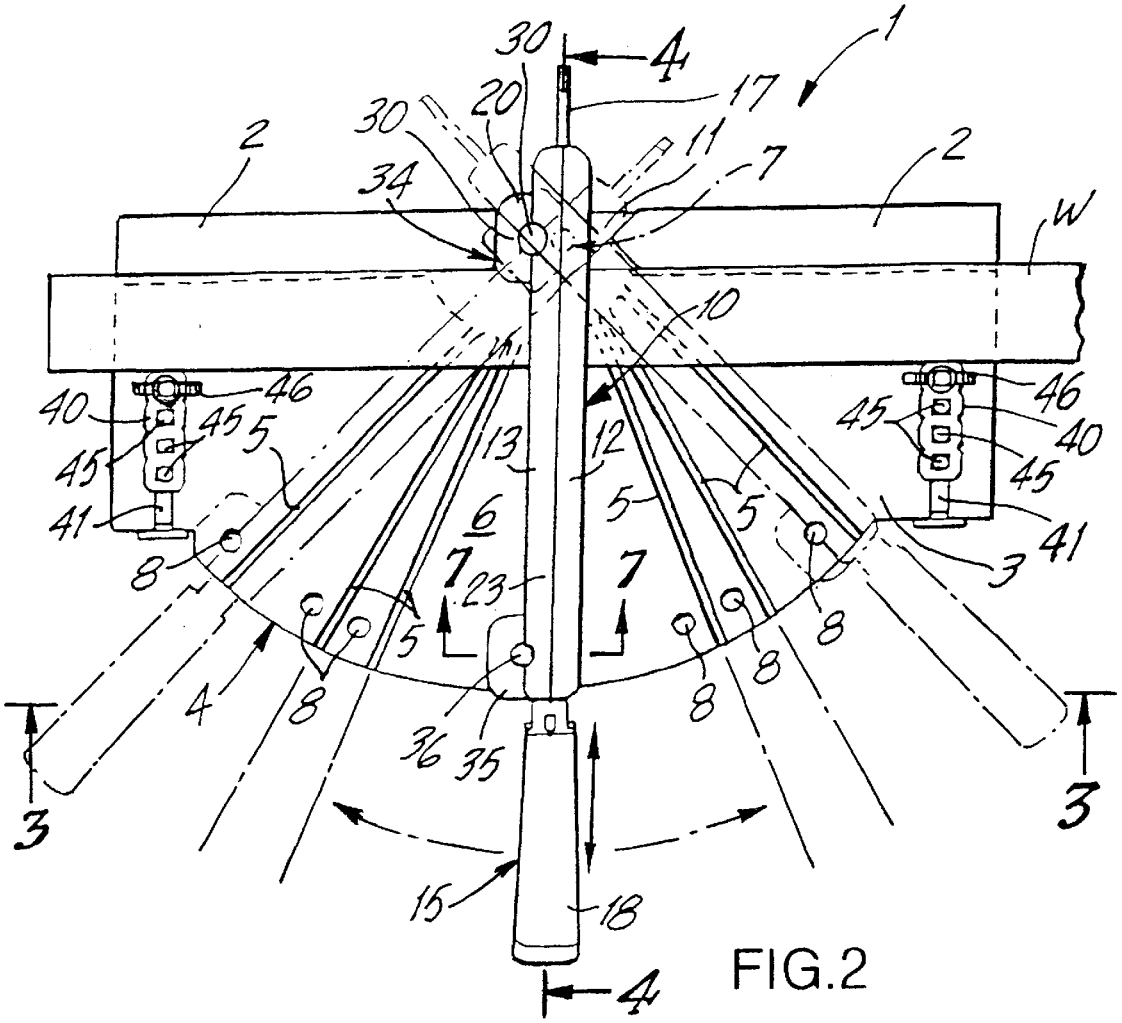
FIG. 2 is a top plan view thereof
Figure 3:
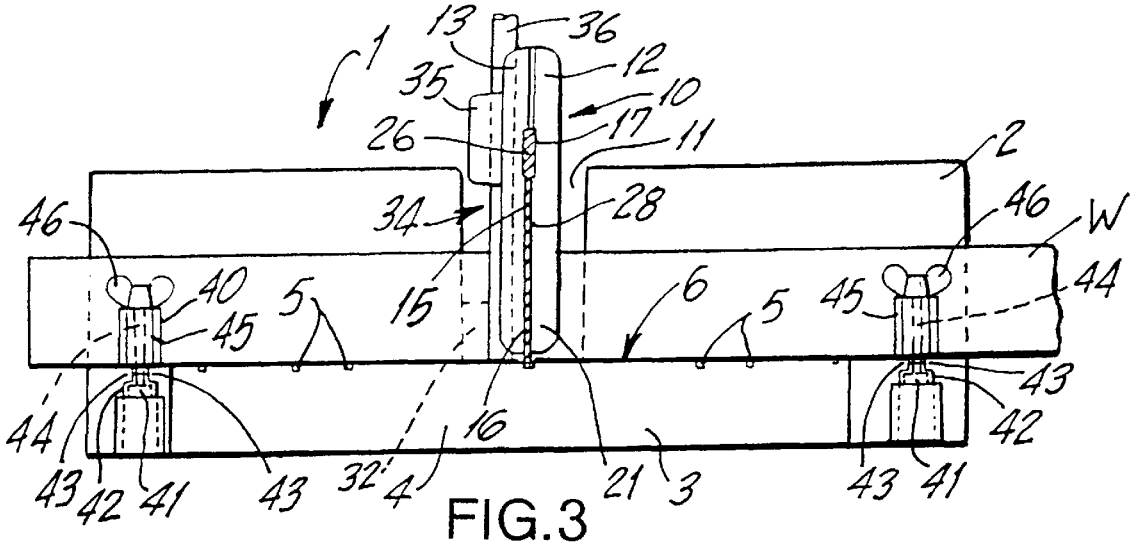
FIG. 3 is a sectional view taken along line 3—3 of FIG. 2.
Figure 4:
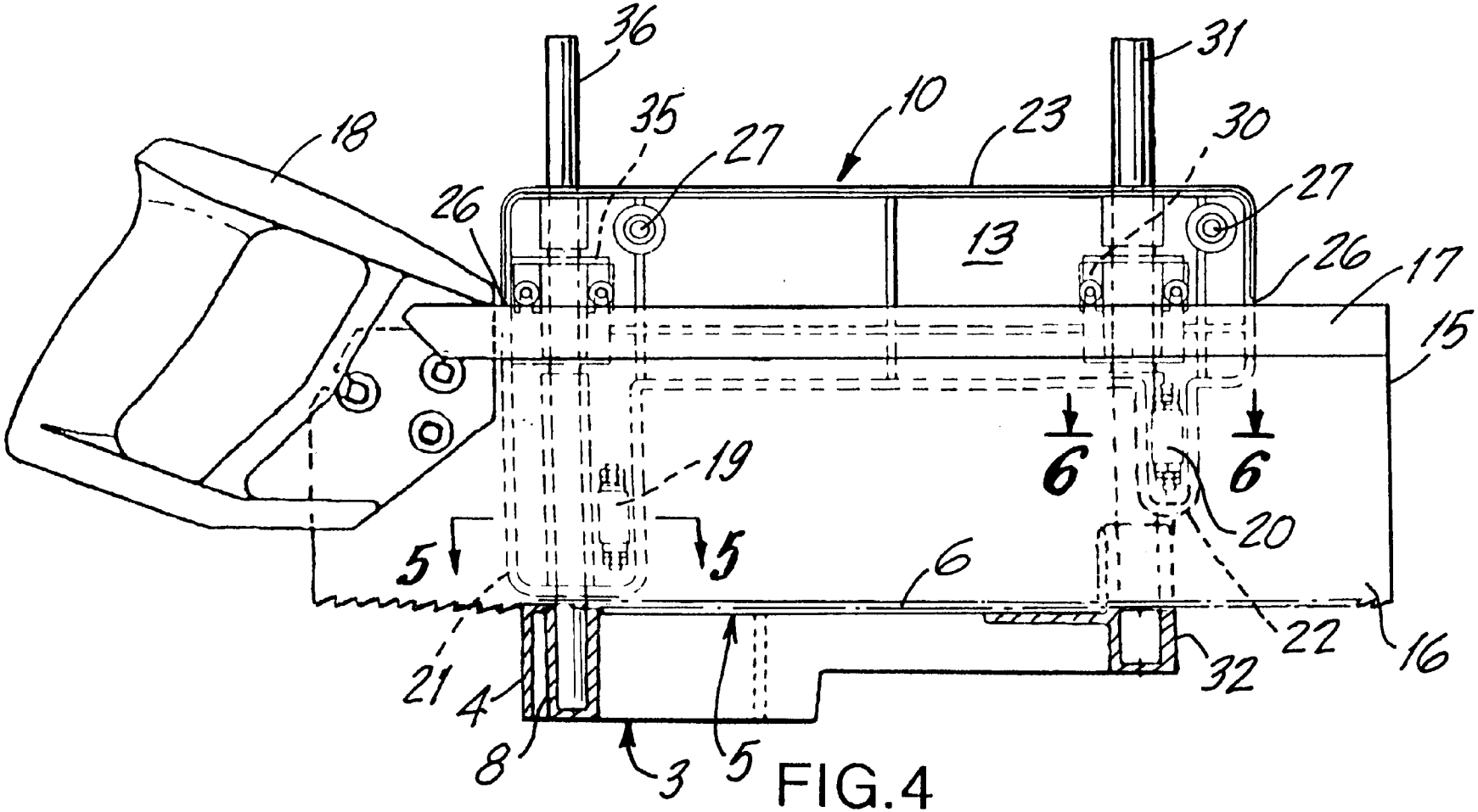
FIG. 4 is a sectional view taken along line 4—4 of FIG. 2.
Figure 6:
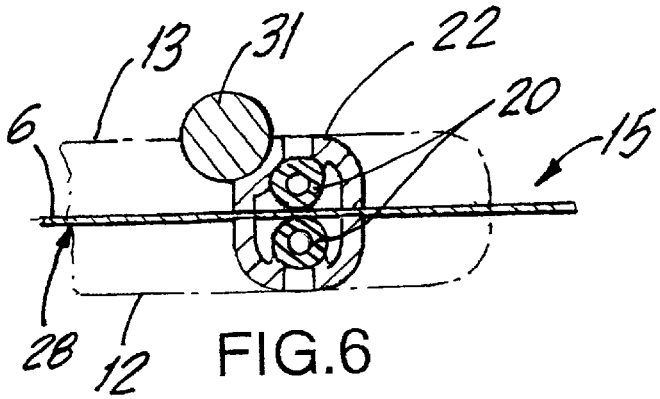
FIG. 6 is a sectional view taken along line 6—6 of FIG. 4.
Figure 5:
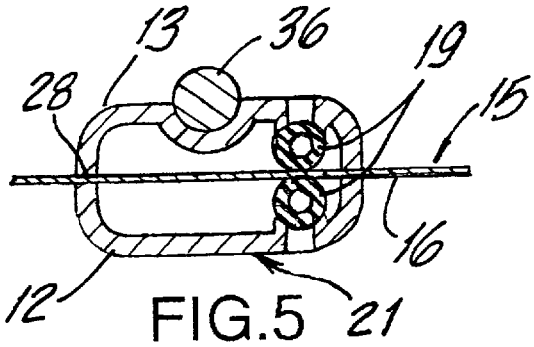
FIG. 5 is a sectional view taken along line 5—5 of FIG. 4.
Figure 7:
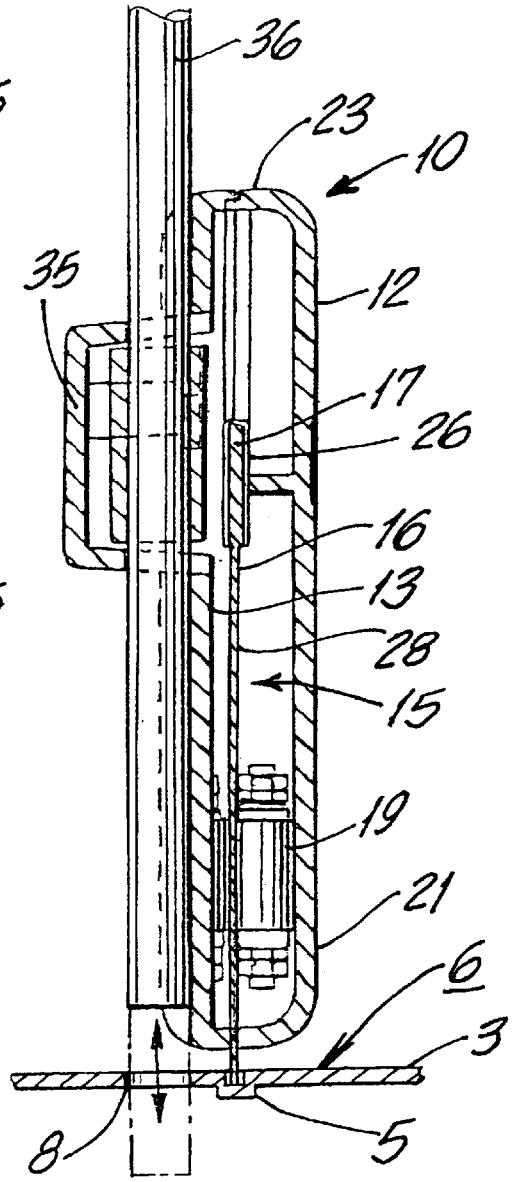
FIG. 7 is a sectional view taken along line 7—7 of FIG. 2.

Referring to the drawings, the adjustable mitre box 1 of the present invention comprises an upstanding side wall 2 and a base 3 extending therefrom. A piece of wood W (FIG. 2) to be cut is placed against side wall 2 and is in position to be cut. The side wall 2 has an interruption or space 11 therein. The base 3 preferably has a curved outer front edge surface 4. However, it will be understood that the outer front edge surface 4 may be made of a different shape without departing from the invention. The top surface 6 of the base 3 has a plurality of top grooves 5 which radiate at different angles from an imaginary pivot point 7 shown in broken lines in FIG. 2. Lock holes 8 (which will be described in greater detail herein below) are provided adjacent each top groove 5.

A saw holder assembly 10 extends through and is pivotally mounted at its front in the space 11 in the side wall 2. The saw holder assembly 10 comprises a pair of matching side plates 12 and 13 (described in greater detail hereinafter) mounted together between which a saw 15 extends for reciprocal movement therebetween. The saw 15 preferably comprises a blade 16, an upper blade clamp 17 and a handle 18. The saw holder assembly has a rear leg 21 and a front leg 22. The rear leg 21 is of greater length than the front leg 21 and extends to a position slightly above and adjacent to the surface 6 of the base 3. The front leg 22 is preferably located in the space 11 in the side wall 2 and is spaced above the surface 6 of the base 3. The two legs 21–22 are connected together by a bridge 23.

The rear edge 24 of the rear leg 21 and the front edge 25 of the front leg 21 has an upper notch 26 to receive the clamp 17 of the saw blade 16 and the lower portions of the legs 21–22 are spaced from each other at 28 to receive the saw blade 16. The space 28 extend to the lower edges of the front and rear legs 21–22 and the top bridge 23 in order to permit the blade 16 to extend downwardly therethrough. The inner spaces of each plate 12–13 are hollow and the two plates 12–13 are adapted to fit together and be held together by any well known mechanism, such as screws 27 to form the saw holder assembly 10. The inner surface of each rear and front leg 21–22, respectively, has a pair of opposed rear rollers 19 and a pair of opposed front rollers 20 between which the blade 16 slide when the wood W is being cut.

The plate 13 has a pivot bearing 30 extending therefrom adjacent the front leg 22 through which extends a pivot rod 31 which is adjacent the imaginary pivot point 7 in the space 11. The pivot rod 31 extends into a pivot bearing 32 which extends from the inner edge 34 of the side wall 2 into the space 11 in the side wall 2. This permits the blade holder assembly 10 to pivot on pivot rod 31 around imaginary pivot point 7 so as to move the blade 15 over the various top grooves 5.

The rear leg 21 of plate 13 is provided with a lock bearing 35 extending therefrom within which a lock rod 36 extends. The lock rod 36 is adapted to be inserted in the lock holes 8 in the base 5 in order to lock the blade holding assembly 10 in place at a predetermined angular position over a top groove 5. The lock hole 8 is spaced from the center of its adjacent top groove 5 a distance which is equal to the spacing between the rod 36 and the saw blade 16 mounted in the blade holder assembly 10. Hence, when the lock rod 36 is inserted into the lock hole 8 the user is assured that the saw blade 16 will overly the desired top groove 5.

When it is desired to operate the adjustable mitre box of the present invention, the blade holder assembly 10 is pivotally moved around pivot rod 31 to the desired angle overlying a top groove 5. When the desired angular position is reached, the lock rod 36 is moved down and inserted into the lock hole 8 adjacent that particular top groove 5. In this position, the saw 15 is reciprocated back and forth to cut the wood W at a particular angle. When it is desired to change the angle of the cut, it is merely necessary to lift the lock rod 36 out of the lock hole 8, swing the blade holder 10 to the desired angle over another top groove 5 and to reinsert the lock rod 36 into the new lock hole 8 adjacent to that particular top groove 5.

In order for wood W of different thicknesses to be held in place while being cut, spaced holding blocks 40 are slidably mounted for movement along spaced grooves 41 on the surface 6 of the base 3. Each holding block is independently movable along a groove 41 in the base 3. Each groove 41 has a channel 42 therebeneath with overhanging top ledges 43. A locking bolt 44 extends through one of the openings 45 (four shown in the drawings) in each of the blocks 40 with the bolt head 46 extending below the surface 6 of the base 5 and into the channel 42 and slidably held within the channel 42 by the overhanging ledges 43. The other (upper) end 47 of the bolt 44 extends above the top of each holding block 40 and can be locked in position by a threaded member 46, such as wingnut. In addition to being independently movable along grooves 41, each holding block 40 may have a plurality of openings 45 (four shown in drawing) which permits the holding block 40 to be independently adjustable relative to the wood W. With this arrangement, it is possible to cut a piece of wood which is of one thickness at one end and another thickness at the other.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mitre box comprising a base, a saw holder assembly pivotally mounted for angular movement over the base, and locking means for locking the saw holder at a predetermined angular position over the base, first pivot means are provided on said base and second pivot means are provided on said saw holder assembly, said locking means comprises first locking mechanism on said saw holder assembly and second locking mechanism on said base, and first and second locking mechanism cooperating with each other to lock the saw holder assembly in place at said predetermined angular position, said second locking mechanism comprises a lock hold in said base and said first locking mechanism comprises a lock element insertable in said lock hole, said lock element comprises a lock rod reciprocally mounted on said saw holder assembly and removably insertable into said lock hole, said first pivot means comprises a base pivot bearing on said base and wherein said second pivot means comprises a pivot rod mounted on said saw holder assembly and insertable into said base pivot bearing, a saw holder pivot bearing extends from the saw holder assembly and wherein said pivot rod extends into said saw holder pivot bearing, said first locking mechanism comprises a lock bearing extending from the saw holder assembly and said lock rod is movably mounted in said lock bearing, a plurality of angular top grooves and a plurality of lock holes are provided in said base, each angular top groove being adjacent to lock hole and wherein said saw holder assembly is adapted to move over said angular top grooves, said saw holder assembly has spaces therein in order to receive a saw blade therewithin, said saw holder assembly is provided with rollers between which a saw blade is adapted to reciprocate, said saw holder assembly has a front leg and a rear leg and wherein said saw holder pivot bearing and said lock bearing are mounted on said front and rear legs, respectfully.

2. A mitre box as set forth in claim 1, wherein said rollers comprise front rollers adjacent said front leg and rear rollers adjacent the rear leg.

3. A mitre box as set forth in claim 2, wherein said saw holder assembly comprises a pair of hollow plates mounted together and wherein said front and rear rollers are mounted between said plates.

4. A mitre box as set forth in claim 3, wherein an upstanding side wall is mounted on said base.

5. A mitre box as set forth in claim 4, wherein said side wall has an opening an wherein said base pivot bearing is located in said opening.

6. A mitre box as set forth in claim 4, wherein at least one holding block is mounted on said base and movable relative to said side wall.

7. A mitre box as set forth in claim 6, wherein said holding block is movable in a groove in said base.

8. A mitre box as set forth in claim 7, wherein said groove has an undercut channel with overhanging ledges.

9. A mitre box as set forth in claim 8, wherein the locking means comprise a locking element having a shaft extending through an opening in the holding block and having a top end and a bottom end and wherein fastener means are provided at the top end to lock the holding block in place and the bottom is mounted in said undercut channel.

10. A mitre box as set forth in claim 9, wherein the holding block has a plurality of openings therein.

11. A mitre box as set forth in claim 10, wherein a plurality of spaced holding blocks are mounted on said base, each holding block each being independently movable relative to said side wall.

* * * * *